US010170234B2

(12) United States Patent
Iwata et al.

(10) Patent No.: US 10,170,234 B2
(45) Date of Patent: Jan. 1, 2019

(54) COIL DEVICE CAPABLE OF PERFORMING A WIRE CONNECTION

(71) Applicant: TDK CORPORATION, Minato-ku, Tokyo (JP)

(72) Inventors: Hiroyuki Iwata, Tokyo (JP); Nobuo Takagi, Tokyo (JP); Hiroyuki Abe, Tsuruoka (JP); Koji Shimura, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/003,602

(22) Filed: Jan. 21, 2016

(65) Prior Publication Data

US 2016/0217919 A1 Jul. 28, 2016

(30) Foreign Application Priority Data

Jan. 22, 2015 (JP) ..... 2015-010314
Jan. 22, 2015 (JP) ..... 2015-010324

(51) Int. Cl.
*H01F 27/29* (2006.01)
*H01F 17/00* (2006.01)
(Continued)

(52) U.S. Cl.
CPC ..... *H01F 27/29* (2013.01); *H01F 17/045* (2013.01); *H01F 27/306* (2013.01)

(58) Field of Classification Search
CPC ..... H01F 17/045; H01F 27/29
See application file for complete search history.

(56) References Cited

U.S. PATENT DOCUMENTS 6,292,083 B1 * 9/2001 Tajima ..... H01F 17/045 336/192
7,477,122 B2 * 1/2009 Iguchi ..... H01F 17/045 336/192

(Continued)

FOREIGN PATENT DOCUMENTS

JP 7-86054 A 3/1995
JP 8-273947 A 10/1996

(Continued)

OTHER PUBLICATIONS

JP2007273757A, Machine Translation, Oct. 2007.*

*Primary Examiner* — Elvin G Enad
*Assistant Examiner* — Malcolm Barnes
(74) *Attorney, Agent, or Firm* — Arent Fox LLP

(57) ABSTRACT

A coil device includes a magnetic core and terminal electrodes. The terminal electrodes include attachment pieces, wire connection rising pieces, connection pieces, and fillet forming pieces. The wire connection rising pieces are integrally risen from one ends in a longitudinal direction of the attachment pieces along a side surface in the X-axis direction of a flange. The connection pieces are integrally formed with upper end sides of the wire connection rising pieces and have welded balls connected to lead parts of a wire by laser welding. The fillet forming pieces are integrally risen from one ends in a lateral direction crossing the longitudinal direction of the attachment pieces along a side surface in the Y-axis direction of the flange. Laser shielding members are arranged between the welded balls and the flange of a magnetic core.

15 Claims, 14 Drawing Sheets

(51) Int. Cl.
*H01F 17/04* (2006.01)
*H01F 27/30* (2006.01)

(56) References Cited

U.S. PATENT DOCUMENTS

2005/0017835 A1* 1/2005 Oki ..... H01F 27/292 336/65
2005/0212643 A1* 9/2005 Kuroiwa ..... H01F 17/045 336/200
2007/0146110 A1* 6/2007 Oki ..... H01F 17/045 336/232
2007/0188286 A1* 8/2007 Yoshimoto ..... H01F 17/045 336/192
2008/0003864 A1* 1/2008 Hatakeyama ..... H01F 17/045 439/399
2008/0003865 A1 1/2008 Hatakeyama et al.
2010/0271162 A1* 10/2010 Yan ..... H01F 17/04 336/192
2011/0279211 A1* 11/2011 Miura ..... H01F 27/29 336/192
2011/0309906 A1 12/2011 Muneuchi et al.
2013/0027161 A1* 1/2013 Urano ..... H01F 17/04 336/83
2013/0027166 A1* 1/2013 Wada ..... H01F 17/04 336/192
2013/0186995 A1* 7/2013 Yamaguchi ..... H01F 5/02 242/432.6
2014/0002227 A1* 1/2014 Hsieh ..... H01F 27/022 336/200

FOREIGN PATENT DOCUMENTS

JP 2007273757 A * 10/2007 ..... H01F 27/29
JP 2008-10753 A 1/2008
JP 2009-38173 A 2/2009
JP 2010-219182 A 9/2010
JP 3171315 U 10/2011
JP 2012-4343 A 1/2012
JP 2013-48281 A 3/2013
WO WO 2009/034860 A1 3/2009

* cited by examiner

COIL DEVICE CAPABLE OF PERFORMING A WIRE CONNECTION

BACKGROUND OF THE INVENTION

1. Field of the Invention

The present invention relates to a coil device, and specifically relates to a coil device capable of performing wire connection in a firm and secure manner.

2. Description of the Related Art

A drum core and a terminal shape as shown in a publication (WO2009/034860), for example, are well known for thinning. In the coil device shown in the publication, however, lead parts of a wire for winding are soldered with terminal electrodes.

Thus, the coil device has a problem that the lead parts of the wire for winding and the terminal electrodes are prone to be connected insufficiently due to heat at the time of soldering for mounting the terminal electrodes on a circuit board, for example. In particular, the lead parts and the terminal electrodes are prone to be connected insufficiently when the lead parts and the terminal electrodes are connected close to a mounting surface for compactness of the device.

It is then discussed to connect the lead part of the wire for winding and the terminal electrode by such as laser welding and thermocompression at a temperature higher than that of solder. When the lead part of the wire for winding and the terminal electrode are connected by such as laser welding and thermocompression at a temperature higher than that of solder, however, a solder fillet is not formed at the lead connection part.

Thus, when a lead connection part is formed at one end in a longitudinal direction of the terminal electrode and a fillet forming part is formed at the other end, no fillet is formed on the lead connection part, and the terminal electrode is thereby affected by external force in the longitudinal direction due to solder formed on the fillet forming part. This external force may dislocate the terminal electrode and the coil device with respect to the circuit board for mounting. Also, a problem that strength between the terminal electrode and the circuit board for mounting is decreased is caused.

When the lead part of the wire for winding and the terminal electrode are connected by laser welding, a magnetic core may be damaged by a laser beam and its reflection during laser welding. It is conceivable that the magnetic core is damaged by breakage and crack due to thermal impact.

A coil device as shown in a publication (JP3171315 (U)) is also known. In this coil device, however, connection pieces for tying lead ends of a wire protrude outside the coil device at terminal electrodes. Then, the protruding portions may contact a device, such as a mounter, during transportation to a mounting machine, and its impact or stress may cause disconnection and break the core.

When a winding terminal without purpose for laser welding of a lead end is arranged near a magnetic core for compactness of the device and welded by laser as it is, the magnetic core may be also damaged by laser beam and its reflection during laser welding.

SUMMARY OF THE INVENTION

The present invention has been achieved in consideration of the circumstances. It is a first object of the invention to provide a coil device capable of performing wire connection in a firm and secure manner and having little damage on a magnetic core. It is a second object of the invention to provide a coil device capable of performing wire connection in a firm and secure manner and preventing dislocation during mounting.

To achieve the first object, the coil device according to the first aspect of the invention comprises:

a magnetic core having a winding core wound by a wire to form a coil; and a terminal electrode attached on an outer end surface of a flange formed at an end in a winding axis direction of the winding core, wherein the terminal electrode comprises:

an attachment piece contacted with the outer end surface of the flange;

a wire connection rising piece integrally risen from one end in a longitudinal direction of the attachment piece along a side surface in a first axis direction of the flange; and a connection piece formed integrally with an upper end side of the wire connection rising piece and having a welded ball connected to a lead part of the wire by laser welding, and wherein a laser shielding member is arranged between the welded ball and the magnetic core.

In the coil device according to the first aspect of the invention, the lead part of the wire for winding and the terminal electrode are connected by laser welding. Thus, the wire can be connected in a firm and secure manner.

In the coil device according to the first aspect of the invention, the laser shielding member is arranged between the connection piece where the welded ball is to be formed and the magnetic core, and thus the magnetic core is not irradiated by a laser beam or its reflection during laser welding. Thus, even if the connection piece is arranged near the magnetic core for compactness of the device, the magnetic core is not damaged by the laser beam or its reflection during laser welding. Thus, the core is not broken or cracked by thermal impact.

Preferably, the shielding member is held in space between the welded ball and the magnetic core. In this configuration, thermal affection of the laser beam at the time of making the welded ball is hard to transmit to the magnetic core, and the magnetic core can receive less damage.

Preferably, the shielding member is formed integrally with the terminal electrode. In this configuration, there is no need to separately preparing the shielding piece, which contributes to reduction in the number of components. Note that, the shielding member is made of ceramic or metal, and may be attached to only a necessary area of the magnetic core or molded integrally.

Preferably, a lead connection part consisting of the welded ball is formed within a range of a thickness of the flange. In this configuration, the coil device can be made compact.

Preferably, an exterior resin surrounds the winding core wound by the wire. The exterior resin surrounds the winding core, which can effectively protect the coil part and prevent a short circuit failure. Also, the exterior resin is preferably made of a resin containing a magnetic body. In this configuration, the exterior resin containing the magnetic body becomes a path of magnetic field, and magnetic characteristics of the coil device are improved.

Preferably, a temporary lock piece for temporarily locking the lead part of the wire is formed integrally with the upper end side of the wire connection rising piece and separately from the connection piece. The temporary lock piece makes it easy to perform laser welding.

Preferably, the side surface in the first axis direction of the flange includes: a rising piece facing plane facing the wire connection rising piece to position the connection piece; and a terminal space concave part caved inside from the rising piece facing plane to form a space between the terminal space concave part and the wire connection rising piece. In this configuration, the connection piece of the terminal electrode is favorably positioned with respect to the flange of the magnetic core, and the lead end of the wire can be more securely connected to the terminal electrode by laser irradiation.

The terminal space concave part reduces thermal impact at the time of performing laser welding against the lead end of the wire and the wire connection part of the terminal electrode, and breakage and crack of the core can be effectively prevented. Also, an external force affected on the terminal electrode is absorbed by the space between the side surface of the flange and the wire connection rising piece, and thus the external force can be effectively prevented from disconnecting the wire and breaking the core. Further, heat dissipation is improved by the space between the side surface of the flange and the wire connection rising piece of the terminal electrode.

Preferably, the shielding member is formed integrally with the wire connection rising piece to shield the magnetic core from being irradiated by a laser beam irradiated for connecting a tip of the lead part of the wire and the connection piece from a direction crossing the side surface in the first axis direction toward the connection piece and the tip of the lead part of the wire. This configuration makes it easy to form the shielding member.

To achieve the second object, the coil device according to the second aspect of the invention comprises:

a magnetic core having a winding core wound by a wire to form a coil; and a terminal electrode attached on an outer end surface of a flange formed at an end in a winding axis direction of the winding core, wherein the terminal electrode comprises:

an attachment piece contacted with the outer end surface of the flange;

a wire connection rising piece integrally risen from one end in a longitudinal direction of the attachment piece along a side surface in a first axis direction of the flange;

a connection piece formed integrally with an upper end side of the wire connection rising piece and connected with a lead part of the wire; and a fillet forming piece integrally risen from one end in a lateral direction crossing the longitudinal direction of the attachment piece along a side surface in a second axis direction of the flange, and wherein the lead part of the wire is connected with the connection piece at a temperature equal to or higher than a melting temperature of a solder fillet to be formed on the fillet forming piece.

In the coil device according to the second aspect of the invention, the lead part of the wire for winding and the terminal electrode are connected by such as laser welding and thermocompression at a temperature higher than that for forming the solder fillet. Thus, the wire can be connected in a firm and secure manner.

In the coil device according to the second aspect of the invention, the solder fillet during mounting is formed on the fillet forming piece integrally risen from one end in the lateral direction crossing the longitudinal direction of the attachment piece along the side surface in the second axis direction of the flange. This solder fillet achieves a firm connection between a circuit board for mounting and the terminal electrode, which can effectively prevent dislocation of the terminal electrode along the longitudinal direction.

Note that, since a pair of the terminal electrodes is attached on the winding axis directional outer end surface of the flange, the dislocation in the lateral direction of the terminal electrode is prevented by interaction of facing joining force of the solder fillets formed at the fillet forming pieces respectively formed a pair of the terminal electrodes.

Preferably, a lead connection part having the lead part of the wire connected with the connection piece is formed within a range of a thickness of the flange. In this configuration, the coil device can be made compact.

Preferably, an exterior resin surrounds the winding core wound by the wire. The exterior resin surrounds the winding core, which can effectively protect the coil part and prevent a short circuit failure. Also, the exterior resin is preferably made of a resin containing a magnetic body. In this configuration, the exterior resin containing the magnetic body becomes a path of magnetic field, and magnetic characteristics of the coil device are improved.

Preferably, the fillet forming piece rises lower than a thickness in a winding axis direction of the flange. In this configuration, the coil device can be made compact. Also, the exterior resin is hardly attached on the fillet forming piece and does not disturb formation of the solder fillet during mounting.

Preferably, an engagement concave part engaged with the fillet forming piece is formed on the side surface in the second axis direction of the flange. The terminal electrode and the magnetic core are easily positioned by engaging the fillet forming piece with the engagement concave part. Also, the exterior resin is hardly attached on the fillet forming piece and does not disturb formation of the solder fillet during mounting.

Preferably, the fillet forming piece has an outer surface that is flush with or dented more than the side surface in the second axis direction other than the engagement concave part. This configuration improves handling characteristics of the coil device before mounting. That is, the edge of the fillet forming piece is not caught with or damage other component or device.

Preferably, a temporary lock piece for temporarily locking the lead part of the wire is formed integrally with the upper end side of the wire connection rising piece and separately from the connection piece. The temporary lock piece makes it easy to perform the laser welding or thermocompression.

Preferably, the side surface in the first axis direction of the flange includes: a rising piece facing plane facing the wire connection rising piece to position the connection piece; and a terminal space concave part caved inside from the rising piece facing plane to form a space between the terminal space concave part and the wire connection rising piece. In this configuration, the connection piece of the terminal electrode is favorably positioned with respect to the flange of the magnetic core, and the lead end of the wire can be more securely connected to the terminal electrode by laser irradiation or thermocompression.

The terminal space concave part reduces thermal impact at the time of performing laser welding against the lead end of the wire to the wire connection part of the terminal electrode, and breakage and crack of the core can be effectively prevented. Also, an external force affected on the terminal electrode is absorbed by the space between the side surface of the flange and the wire connection rising piece, and thus the external force can be effectively prevented from disconnecting the wire and breaking the core. Further, heat dissipation is improved by the space between the side surface of the flange and the wire connection rising piece of the terminal electrode.

Preferably, the shielding member is formed integrally with the wire connection rising piece to shield the magnetic core from being irradiated by a laser beam irradiated for connecting a tip of the lead part of the wire and the connection piece from a direction crossing the side surface in the first axis direction toward the connection piece and the tip of the lead part of the wire. In this configuration, the shielding member shields thermal impact at the time of performing laser welding or thermocompression against the lead end of the wire and the wire connection part of the terminal electrode, and breakage and crack of the core can be effectively prevented.

DESCRIPTION OF THE PREFERRED EMBODIMENTS

Hereinafter, the present invention will be explained based on an embodiment shown in the figures.

A coil device 2 according to one embodiment of the present invention shown in FIG. 1A to FIG. 1F is used as a choke coil or a noise filter, for example. In particular, the coil device 2 is preferably used for vehicles.

Figure 2:
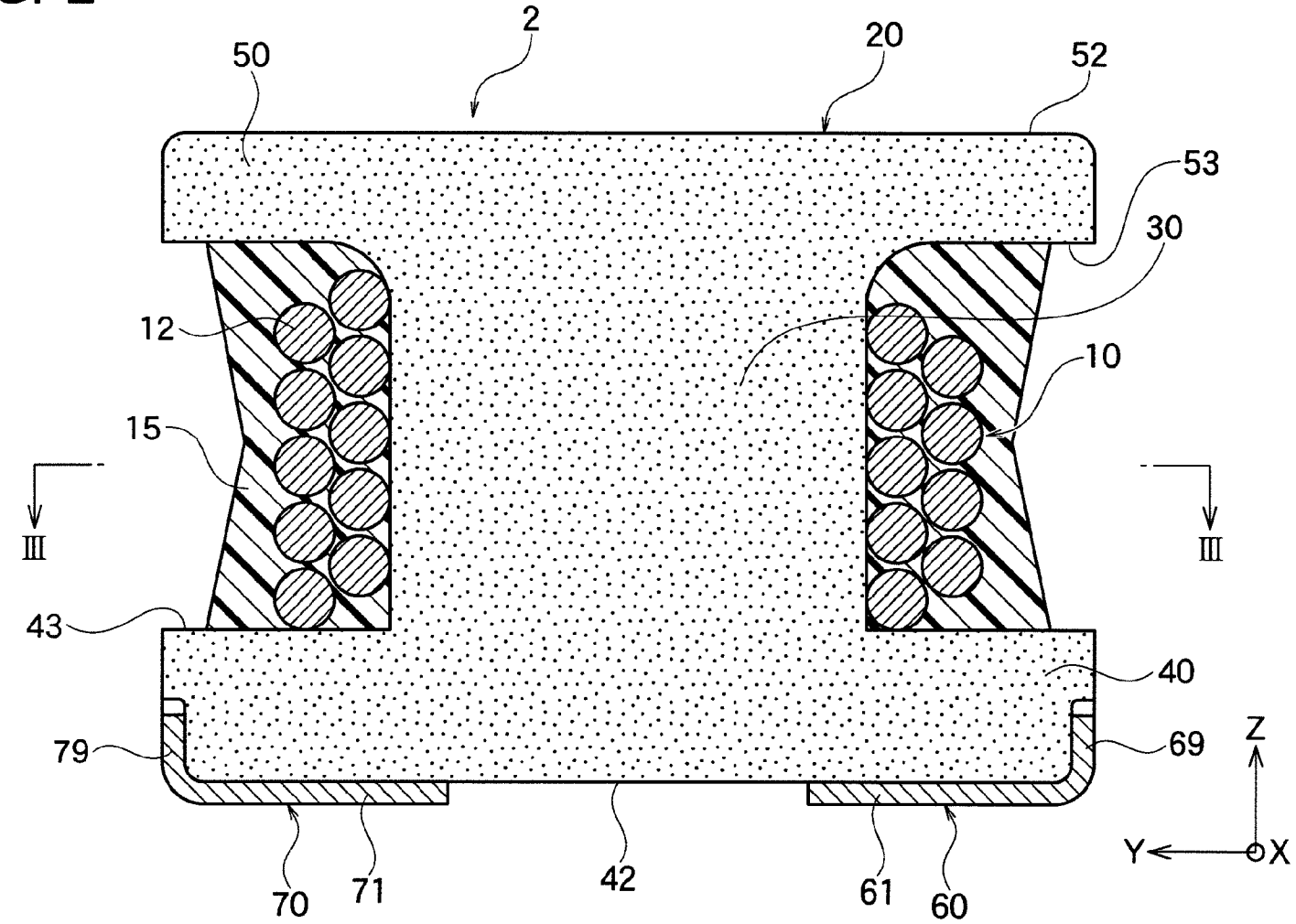
FIG. 2 is a schematic cross section taken along the II-II line shown in FIG. 1A.

As shown in FIG. 2, the coil device 2 has a drum core 20 as a magnetic core. The drum core 20 is made of any magnetic material, such as soft magnetic material of metal or ferrite. The drum core 20 has a winding core 30 wound by a wire 12 of a coil part 10 along a winding axis direction of the core 20.

Preferably, an exterior resin 15 surrounds the winding core 30 wound by the wire 12. In this configuration, the coil part 10 can be effectively protected, and a short circuit failure can be prevented. Also, the exterior resin 15 is preferably made of a resin containing a magnetic body. In this configuration, the exterior resin 15 containing a magnetic body becomes a path of magnetic field, and the coil device 2 has improved magnetic characteristics. The exterior resin 15 contains any magnetic body, such as magnetic powder as with that of the core 20 and other magnetic powder.

Any wire can be used as the wire 12. For example, a rectangular wire of copper, a conductive core wire of round wire, stranded wire, litz wire, or braided wire, or an insulated wire of these conductive core wires can be used. Specifically, a well-known wire for winding, such as polyimide wire (AIW), polyurethane wire (UEW), UEW, and USTC, can be used. The wire 12 has any diameter, and has a diameter of 0.1 to 0.5 mm, for example.

A first flange 40 and a second flange 50 are integrally formed at both ends in the winding axis direction (the Z-axis direction) of the winding core 30. The first flange 40 and the second flange 50 protrude from the winding core 30 toward the X-Y axis plane. Note that, the X-axis, the Y-axis, and the Z-axis are vertical to each other, and that the Z-axis corresponds with the winding axis direction.

Figure 3:
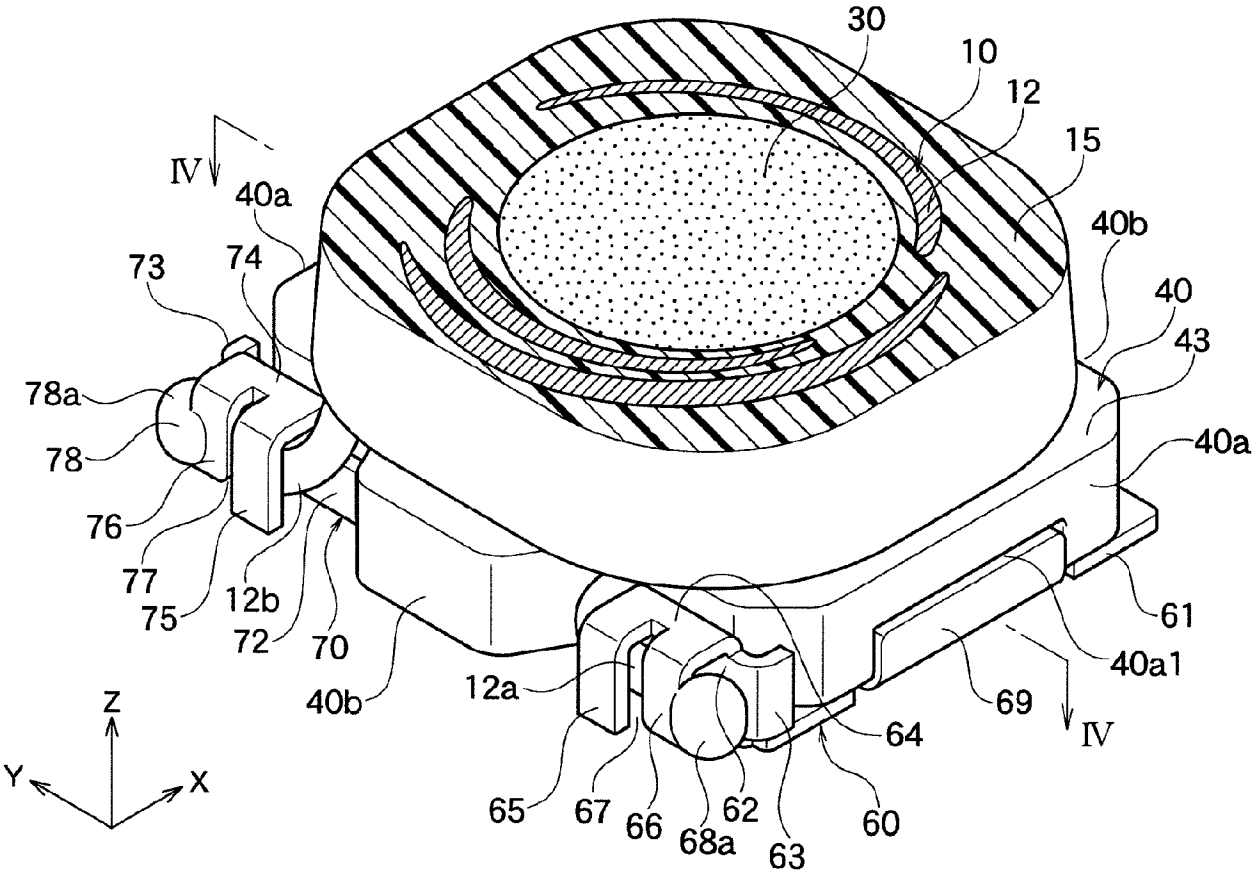
FIG. 3 is a perspective view of cross section taken along the line shown in FIG. 2.

The winding core 30 has any cross sectional shape (cross section of the X-Y axis plane), such as square, rectangular, circular, or other shape, but has a substantially circular shape as shown in FIG. 3 in this embodiment.

As shown in FIG. 2, the second flange 50 has a second axis directional outer end surface 52 and a second axis directional inner end surface 53 located opposite thereto. An upper end in the Z-axis direction of the coil part 10 is located at the second axis directional inner end surface 53. Note that, FIG. 2 shows that the coil part 10 is formed by doubly winding the wire 12 around the winding core 30, but the wire 12 is wound with any number of winding layers, such as twice or more. Also, the wire 12 is wound by any winding method.

Figure 1A:
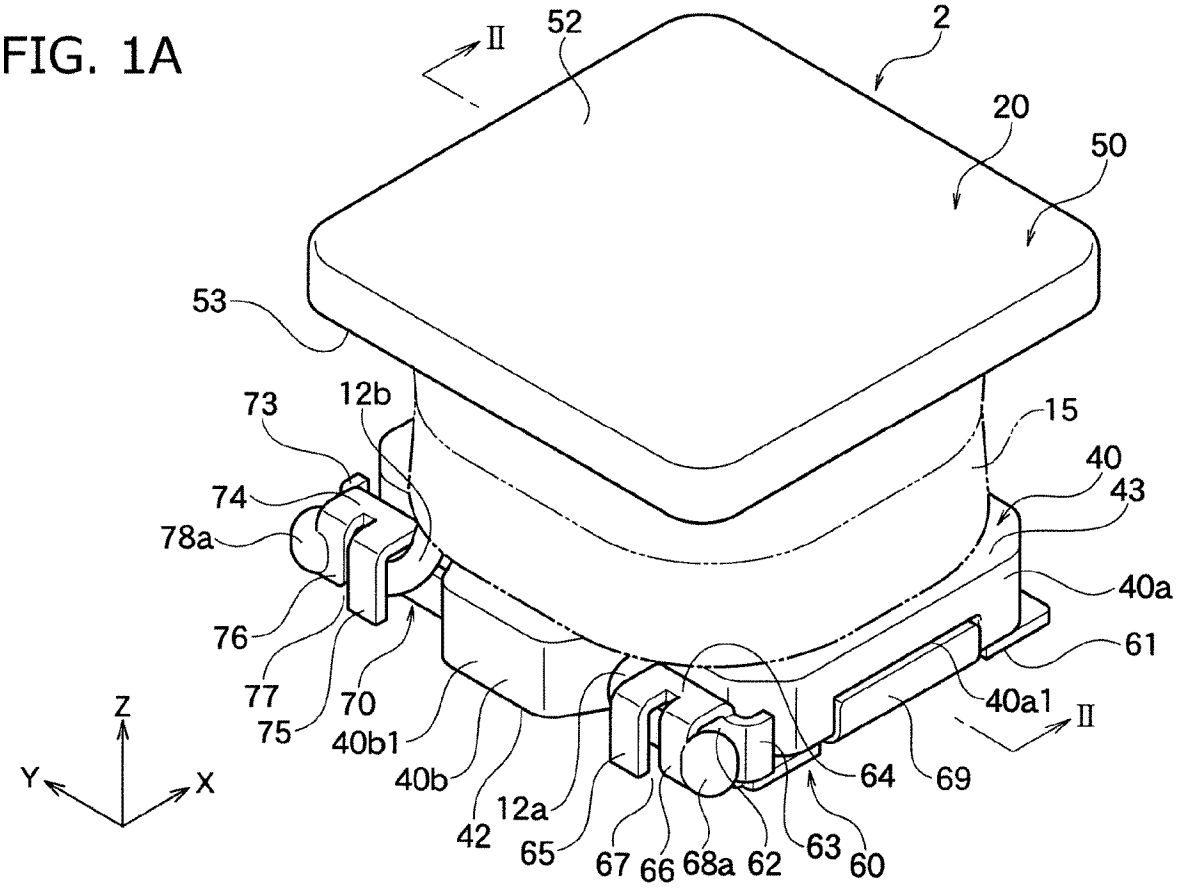
FIG. 1A is a perspective view of a coil device according to one embodiment of the present invention.
Figure 1B:
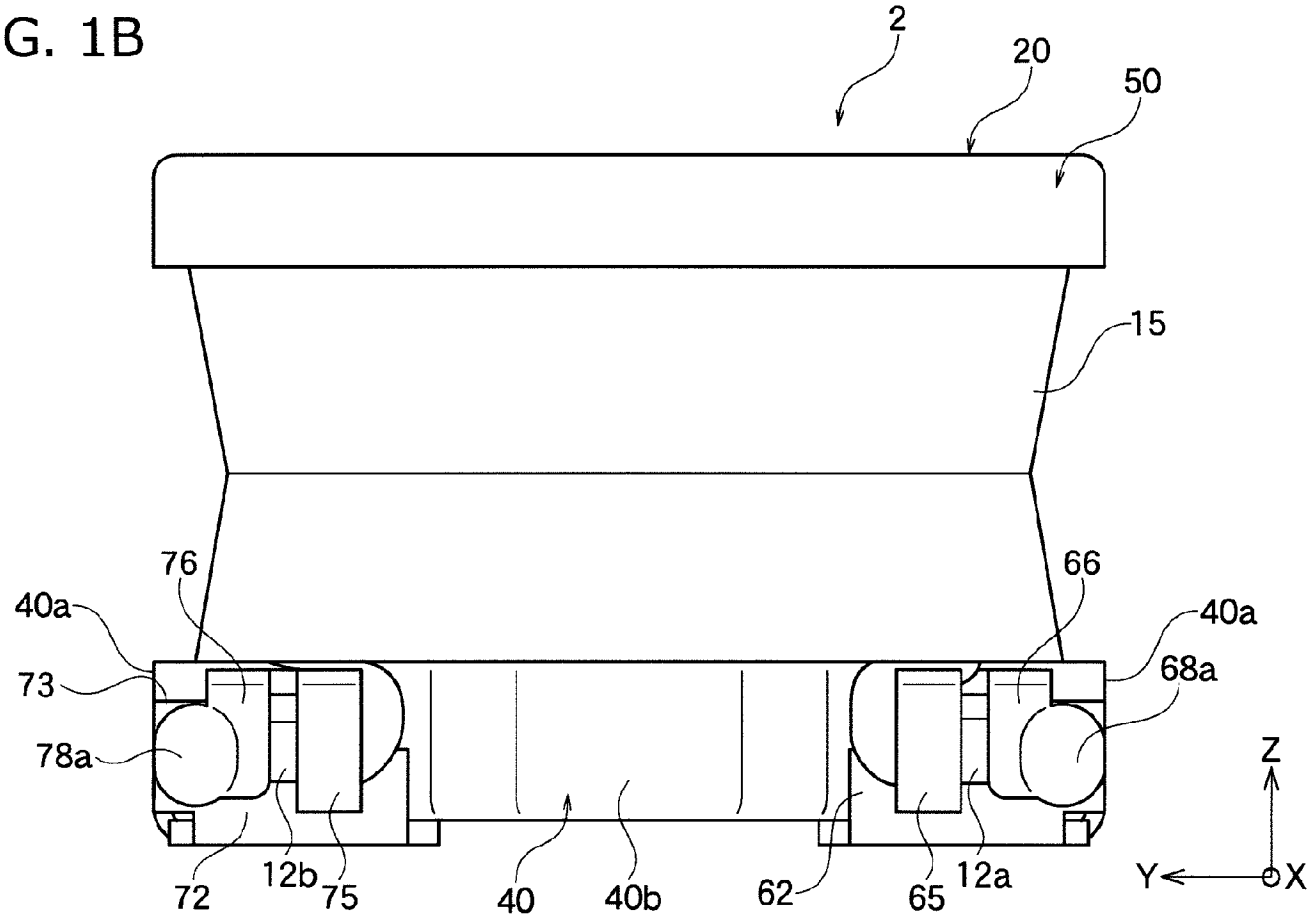
FIG. 1B is a front view of the coil device shown in FIG. 1.
Figure 1C:
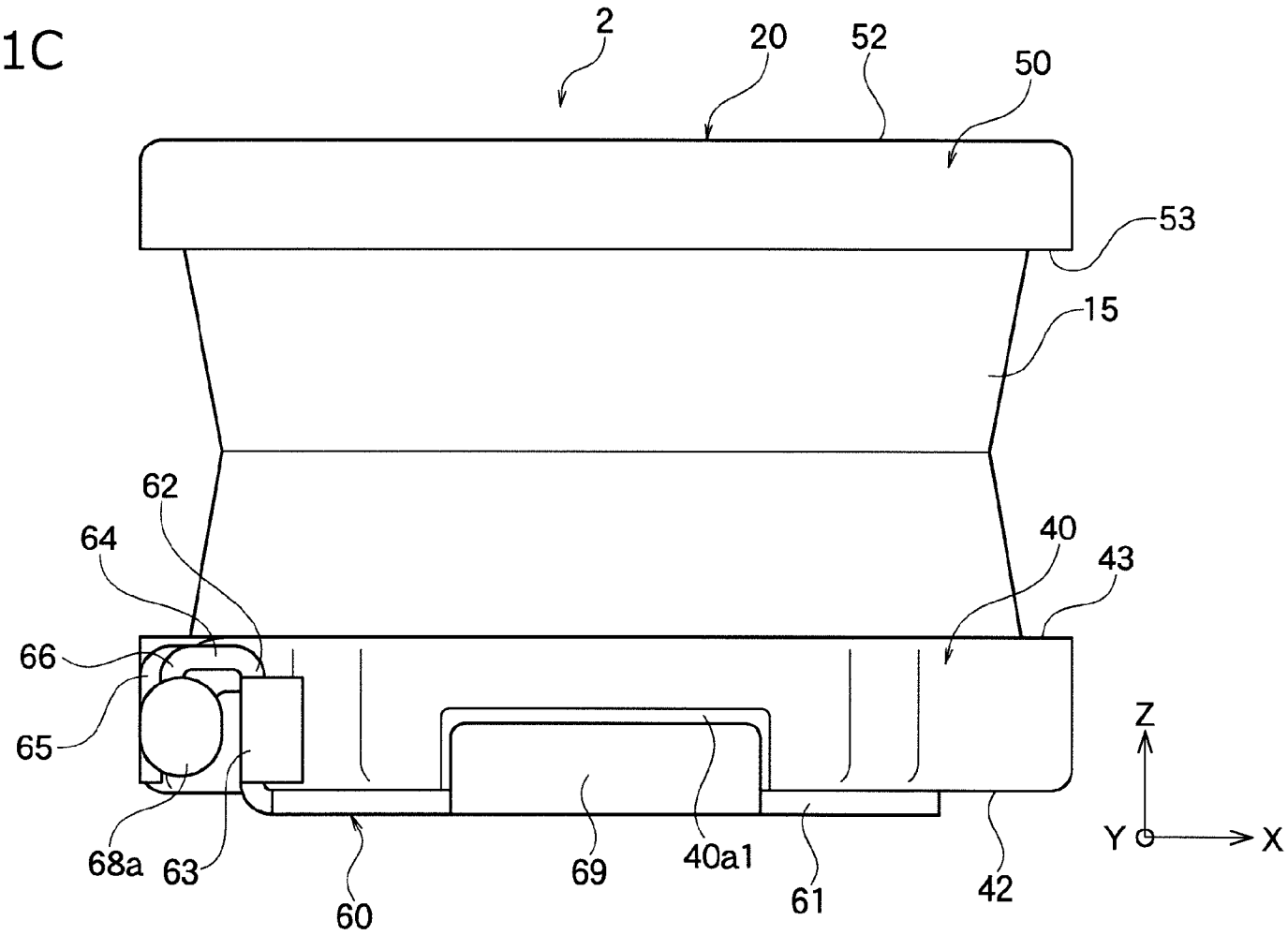
FIG. 1C is a right side view (a left side view is symmetrical to the right side view) of the coil device shown in FIG. 1.
Figure 1D:
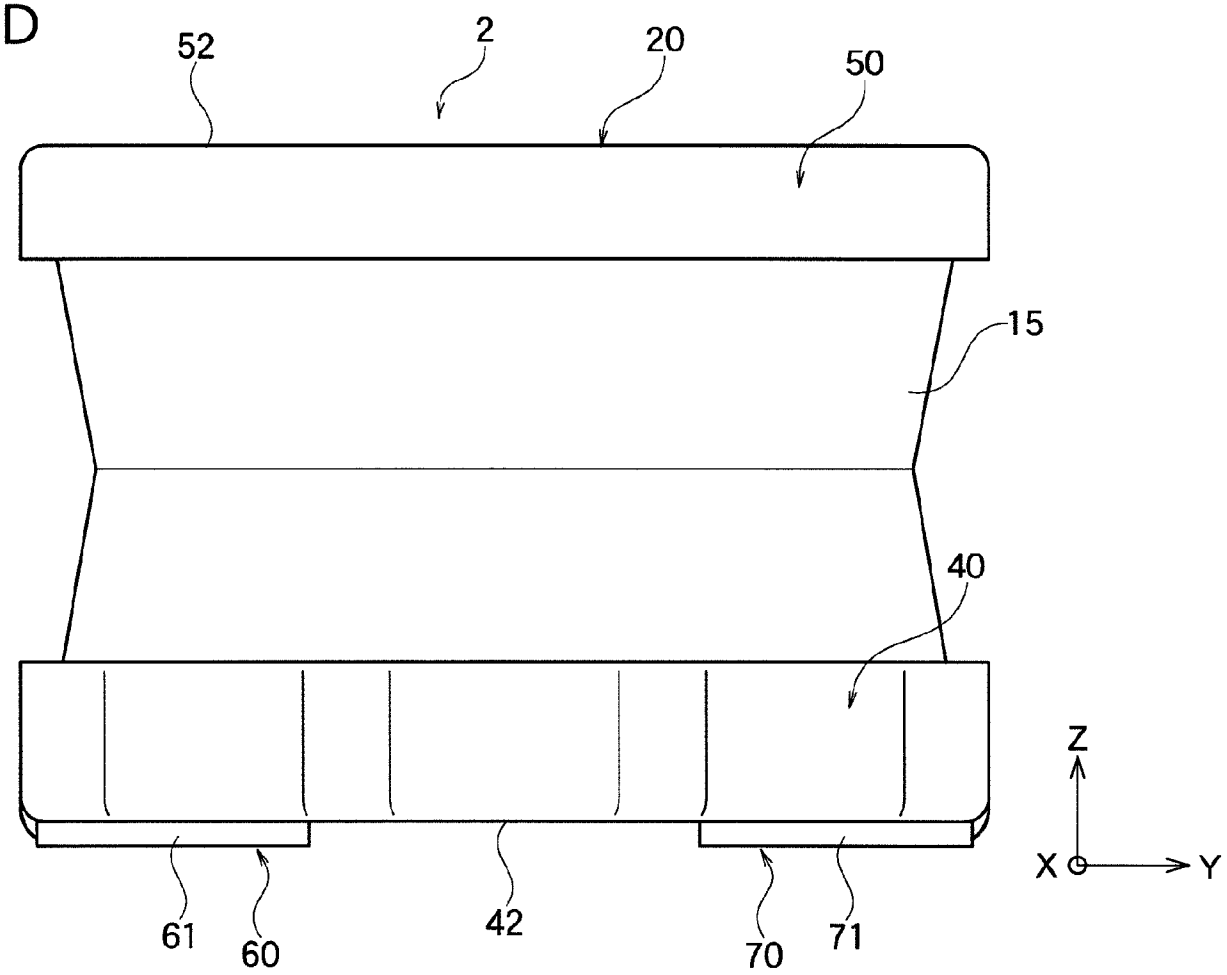
FIG. 1D is a back view of the coil device shown in FIG. 1.
Figure 1E:
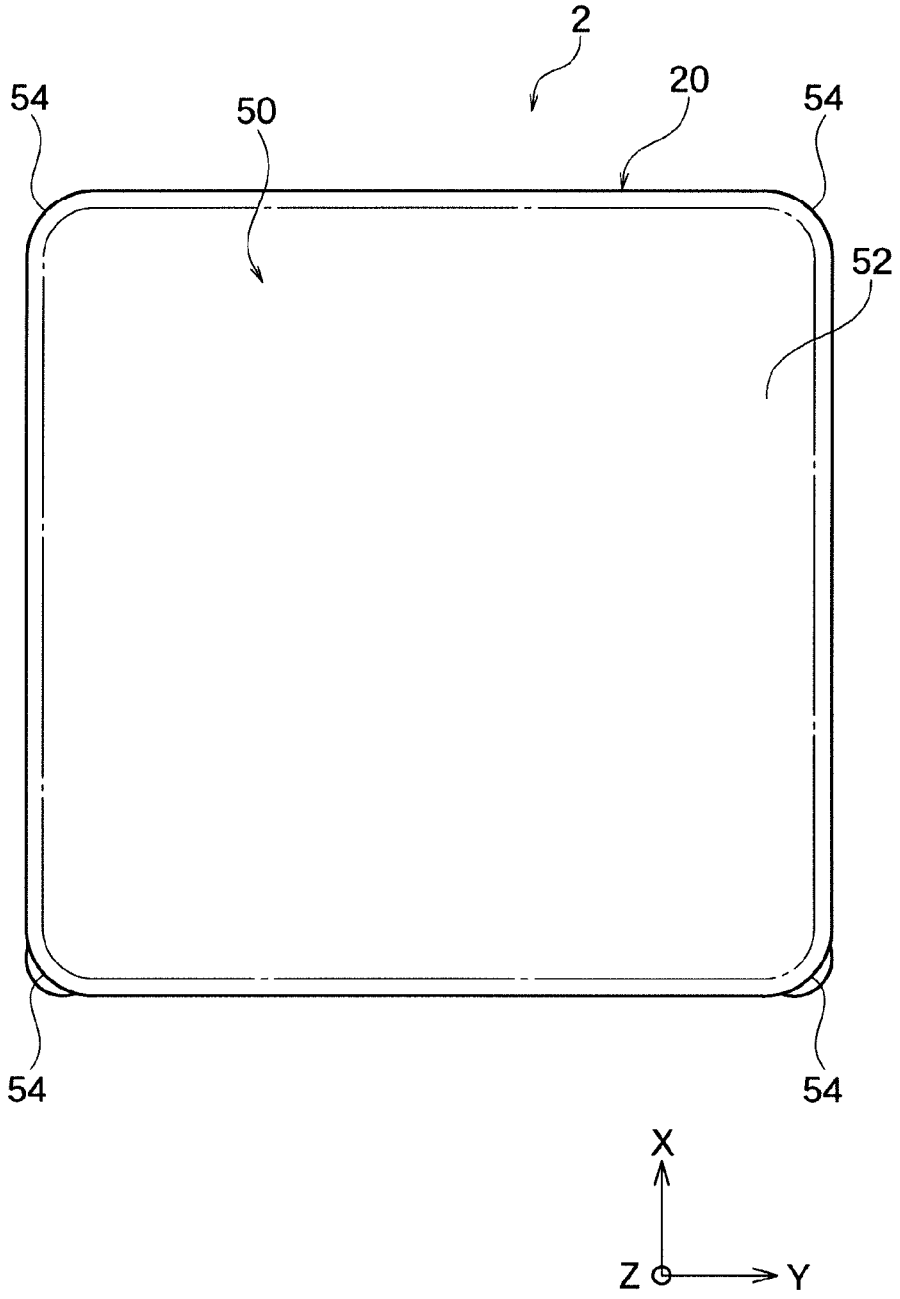
FIG. 1E is a plane view of the coil device shown in FIG. 1.
Figure 1F:
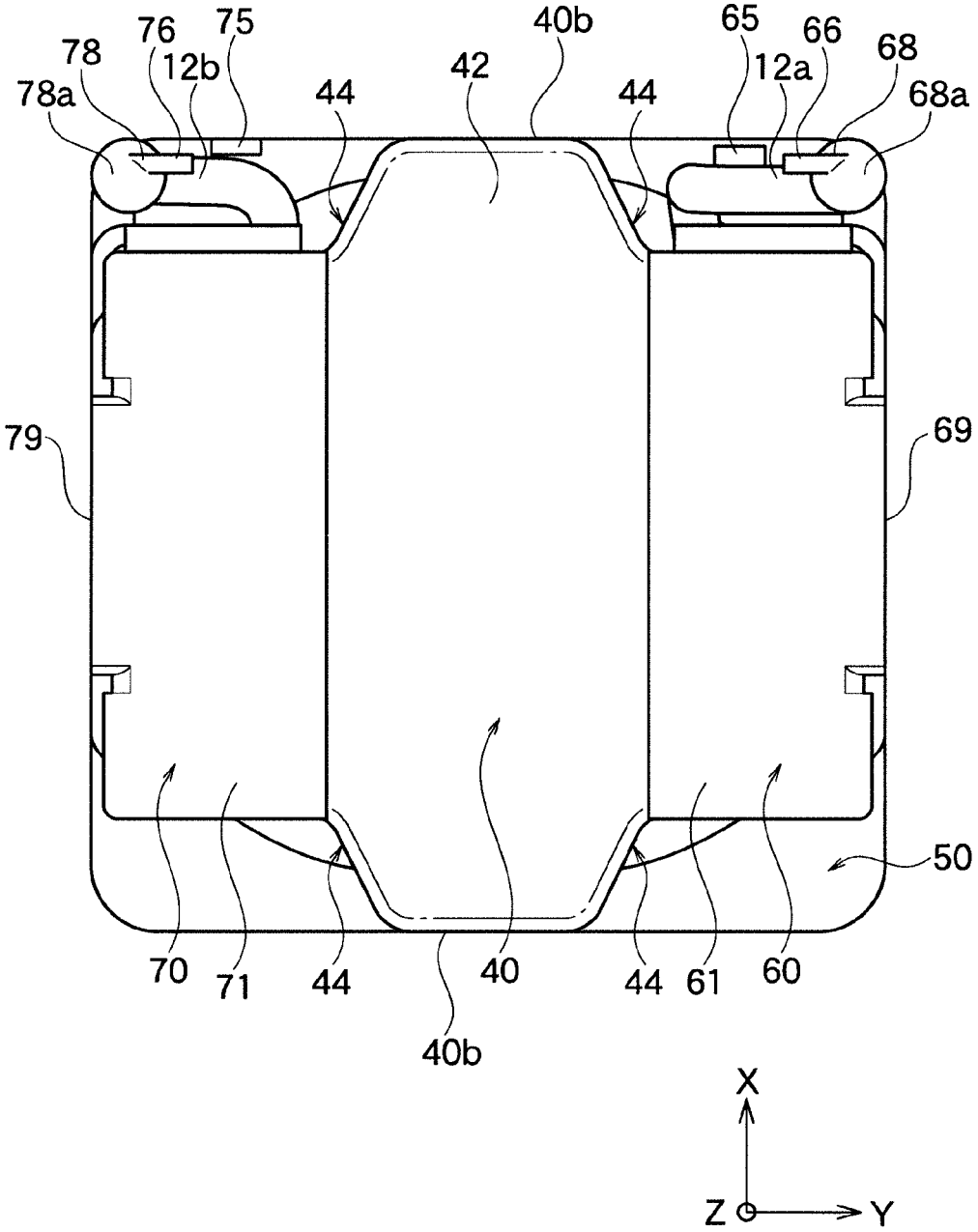
FIG. 1F is a bottom view of the coil device shown in FIG. 1.

In this embodiment, as shown in FIG. 1F, the first flange 40 and the second flange 50 have mutually different planar shapes, and the second flange 50 has an outer shape that is larger than that of the first flange 40. The second flange 50 has any planar shape. In this embodiment, as shown in FIG. 1E, the second flange 50 has a square shape as a whole, and R parts 54 are formed at four corners. The R parts 54 are formed integrally with the first flange 40, the second flange 50, and the winding core 30 during molding of the drum core 20 shown in FIG. 5, but may be formed by such as machining process and polishing process after the integral molding.

As shown in FIG. 1E, when viewing the drum core 20 from the second axis directional outer end surface 52 of the second flange 50 in the Z-axis direction, the second flange 50 has the planar shape covering the first flange 40 inside the second flange 50, and the first flange 40 cannot be seen.

As shown in FIG. 2, the first flange 40 has a winding axis directional outer end surface 42 and a winding axis directional inner surface 43 located opposite thereto. A lower end in the Z-axis direction of the coil part 10 is located at the winding axis directional inner surface 43. A first terminal electrode 60 and a second terminal electrode 70 are bonded by adhesive or so with both ends in the Y-axis direction of the winding axis directional outer end surface 42 of the first flange 40.

Although details will be mentioned below, the first terminal electrode 60 and the second terminal electrode 70 have shapes symmetrical to the X-axis and are made of conductive metal, such as Tough-Pitch Copper, phosphor bronze, brass, iron, and nickel, for example.

Figure 4:
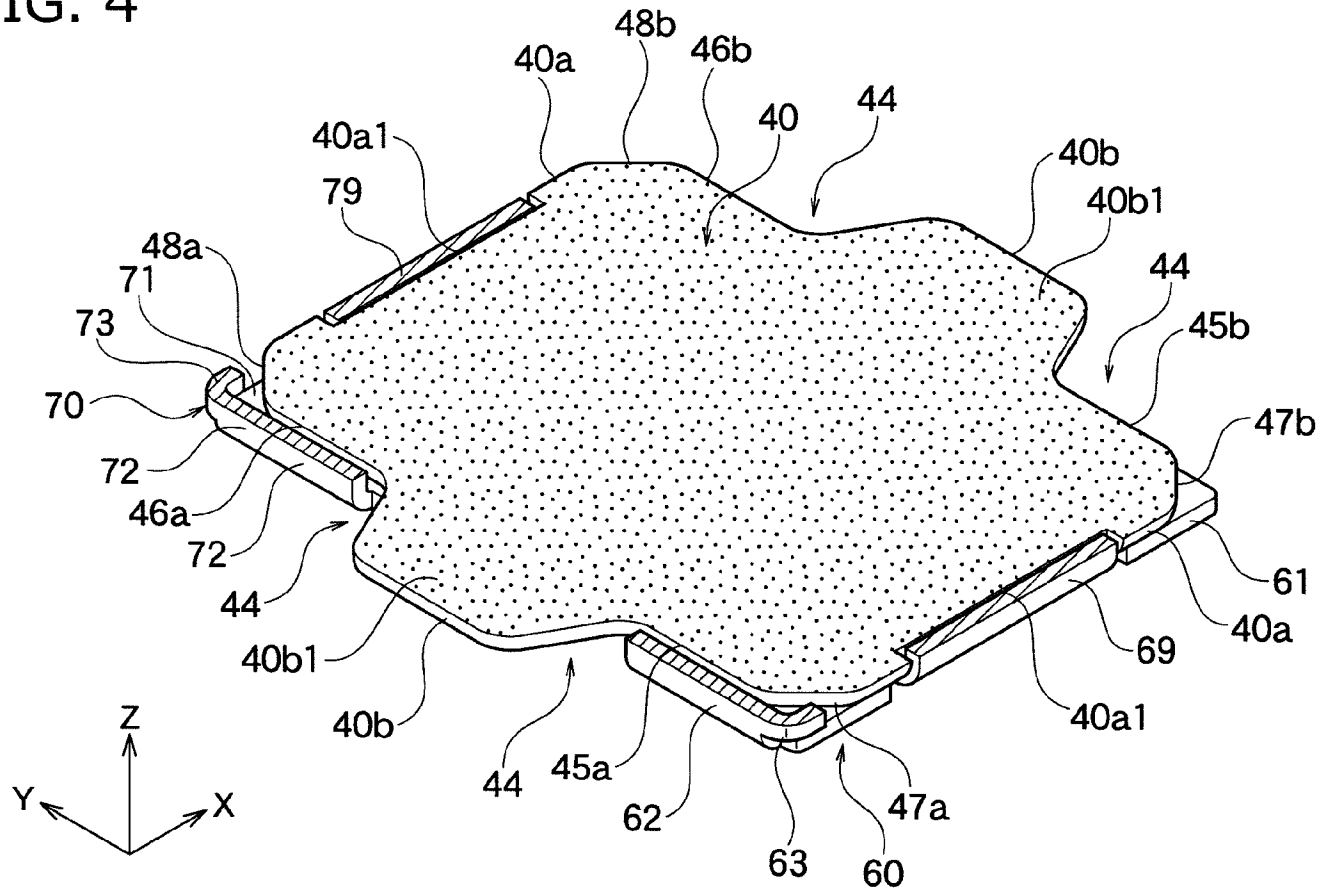
FIG. 4 is a perspective view of cross section taken along the IV-IV line shown in FIG. 3.

The first flange 40 has any planar shape. In this embodiment, as shown in FIG. 1F and FIG. 4, the first flange 40 has the planar shape whose gravity center is located at substantially the same position as that of the second flange 50 (and the winding core 30) in the X-Y axis plane. Further, the first flange 40 has notches 44 at its four corners dented more largely than the four corners of the second flange 50.

Figure 5:
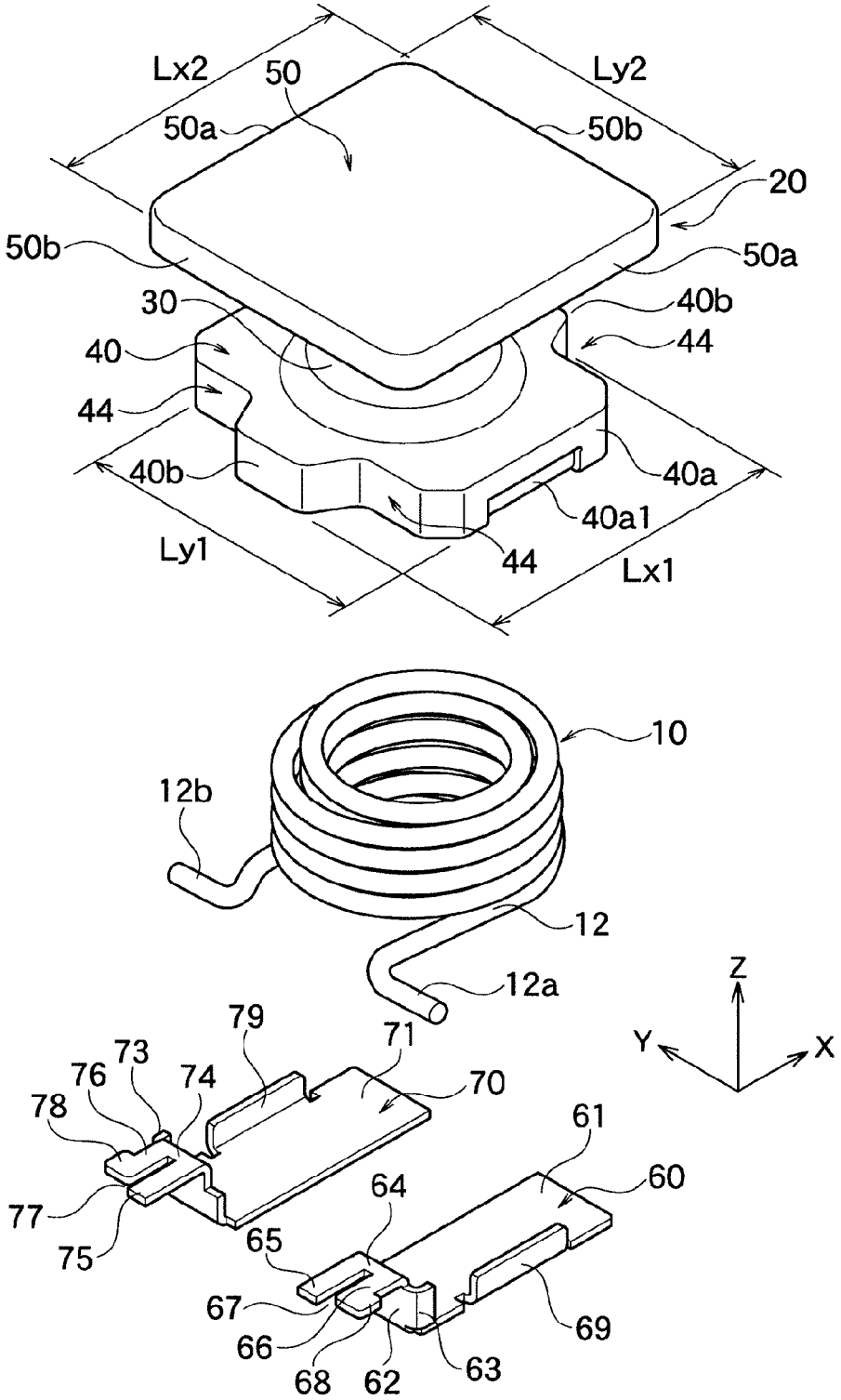
FIG. 5 is a disassembled perspective view of the coil device shown in FIG. 1.

As shown in FIG. 5, a maximum width Ly1 in the Y-axis direction of the first flange 40 is approximately equal to or shorter than a maximum width Ly2 in the Y-axis direction of the second flange 50, and side surfaces 40*a* in the Y-axis direction of the first flange 40 approximately correspond with side surfaces 50*a* in the Y-axis direction of the second flange 50 or are dented in the Y-axis direction.

A maximum width Lx1 in the X-axis direction of the first flange 40 is approximately equal to or shorter than a maximum width Lx2 in the X-axis direction of the second flange 50. Also, side surfaces 40*b* in the X-axis direction of the first flange 40 other than middle parts in the Y-axis direction are dented in the X-axis direction at portions corresponding to the notches 44 with respect to side surfaces 50*b* in the X-axis direction of the second flange 50.

As shown in FIG. 4, trapezoidal convex parts 40*b*1 protruding outside in the X-axis direction at the middle parts in the Y-axis direction are formed on the side surfaces 40*b* in the X-axis direction of the first flange 40. Also, the respective notches 44 include rising piece facing planes 45*a* and 45*b* or opposite planes 46*a* and 46*b*, and include terminal space concave parts 47*a* and 47*b* or opposite concave parts 48*a* and 48*b* dented inside therefrom. Relations among the planes 45*a*, 45*b*, 46*a*, and 46*b*, the concave parts 47*a*, 47*b*, 48*a*, and 48*b*, and the terminal electrodes 60 and 70 are mentioned below.

Figure 6:
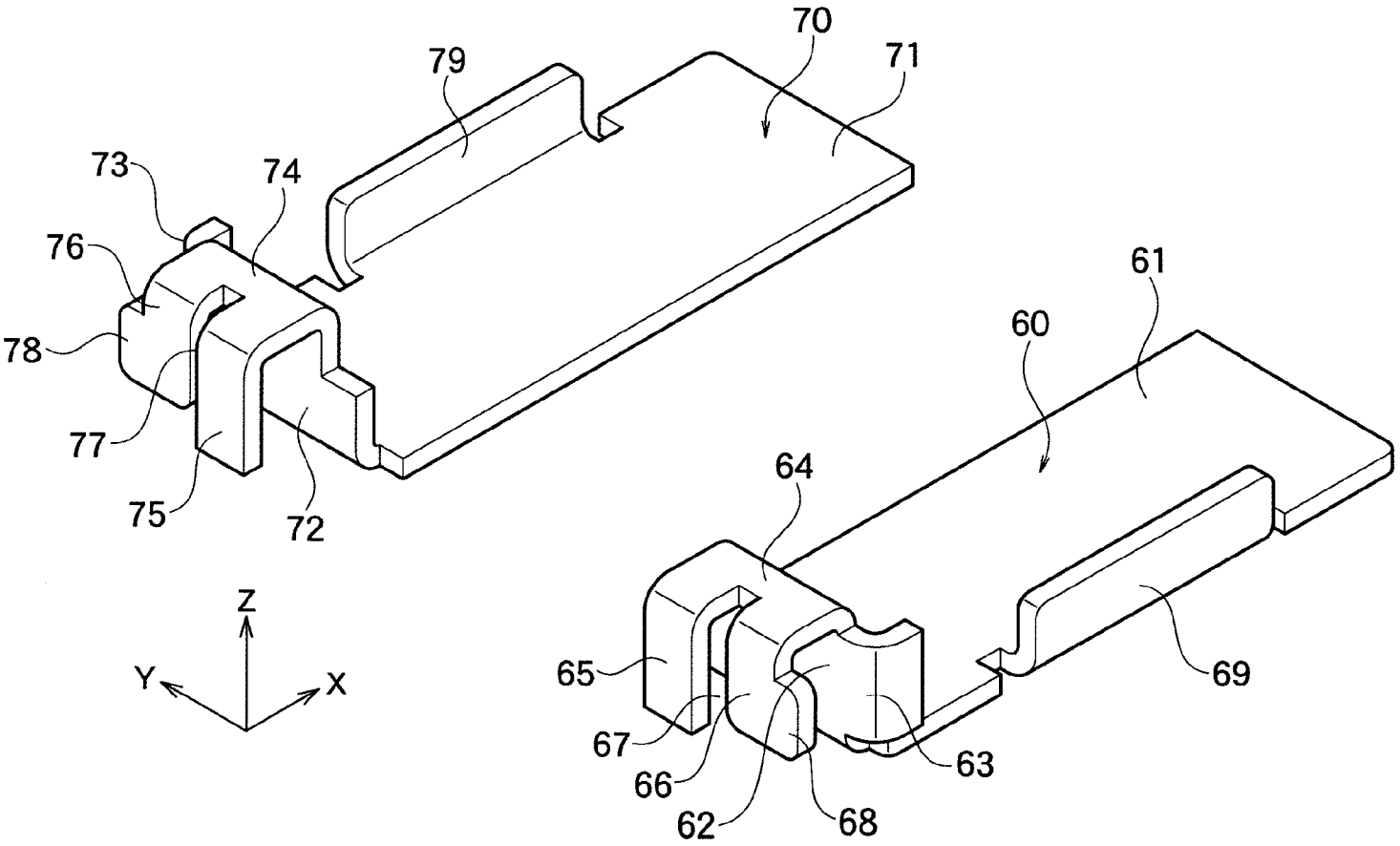
FIG. 6 is an enlarged perspective view of terminal electrodes shown in FIG. 5.

As shown in FIG. 5 and FIG. 6, the first terminal electrode 60 and the second terminal electrode 70 have attachment pieces 61 and 71 that are narrow and long in the X-axis direction. As shown in FIG. 2, the attachment pieces 61 and 71 are bonded by such as adhesive with both ends in the Y-axis direction of the winding axis directional outer end surface 42 of the first flange 40. A terminal attachment groove whose shape is fitted with the attachment pieces 61 and 71 may be formed on the outer end surface 42 to be bonded with the attachment pieces 61 and 71.

The terminal attachment groove preferably has a depth that is smaller than a thickness of the attachment pieces 61 and 71, and the attachment pieces 61 and 71 preferably has bottom surfaces protruding further than the winding axis directional outer end surface 42. This configuration facilitates a mounting operation for connecting the attachment pieces 61 and 71 of the coil device 2 to electrode patterns, such as circuit board.

As shown in FIG. 5 and FIG. 6, wire connection rising pieces 62 and 72 are formed integrally at one ends in the X-axis direction of the attachment piece 61 and the attachment piece 71 so as to rise in the Z-axis direction, and no rising pieces are formed at the other ends.

As shown in FIG. 4, the rising pieces 62 and 72 can be respectively contacted with the rising piece facing planes 45*a* and 46*a* formed on one of the side surfaces 40*b* of the first flange 40 and form spaces between the rising pieces 62 and 72 and the terminal space concave parts 47*a* and 48*a*. The terminal electrodes 60 and 70 are not engaged on the opposite planes 45*b* and 46*b* and the opposite concave parts 47*b* and 48*b* formed on the other side surface 40*b* of the first flange 40.

The wire connection rising piece 62 contacts with the rising piece facing plane 45*a*, which positions the first terminal electrode 60 in the X-axis direction with respect to the first flange 40. Preferably, the first terminal electrode 60 is made of conductive metal and has spring property. Note that, there may be a slight space between the rising piece facing plane 45*a* and the wire connection rising piece 62.

Similarly, the rising piece 72 contacts with the rising piece facing plane 46*a*, which positions the second electrode 70 in the X-axis direction with respect to the first flange 40. Preferably, the second terminal electrode 70 is made of conductive metal and has spring property. Note that, there may be a slight space between the rising piece facing plane 46*a* and the rising piece 72.

Grip pieces 64 and 74 as wire connection parts are formed integrally at the upper ends in the Z-axis direction of the wire connection rising pieces 62 and 72 formed one ends in the X-axis direction of the attachment pieces 61 and 71. As shown in FIG. 3, the grip pieces 64 and 74 are formed by being bent to the rising pieces 62 and 72 so as to be substantially flush with the winding axis directional inner surface 43 of the first flange 40 (or lower than the winding axis directional inner surface 43 in the Z-axis direction).

As shown in FIG. 1A, the grip piece 64 as the wire connection part consists of a temporary lock piece 65 and a connection piece 66. The temporary lock piece 65 is located inside in the Y-axis direction of the connection piece 66, and is located closer to the trapezoidal convex part 40*b*1 at the middle of the side surface 40*b* in the X-axis direction of the first flange 40. There is a space capable of passing a lead part 12*a* of the wire 12 between the trapezoidal convex part 40*b*1 and the temporary lock piece 65. Also, a slit 67 extending in the X-axis direction and the Z-axis direction is formed between the temporary lock piece 65 and the connection piece 66. The slit 67 has any thickness in the Y-axis direction, but this thickness is preferably 0.1 to 0.5 mm.

The lead part 12*a*, which is one end of the wire 12, is sandwiched by the temporary lock piece 65 and the wire connection rising piece 62, and is temporarily locked before laser welding of the lead part 12*a* mentioned below. The lead part 12*a*, which is one end of the wire 12, is sandwiched by the connection piece 66 and the wire connection rising piece 62, and the connection piece 66 is integrated at a lead connection part 68*a* formed outside thereof in the Y-axis direction to be electrically connected with the lead part 12*a*.

As shown in FIG. 5 to FIG. 9, a broad portion 68 whose width is larger than that of a base end part is formed at a tip of the connection piece 66 before forming the lead connection part 68*a*, and the broad portion is to mainly be the lead connection part 68*a*. The broad portion 68, however, may not be necessarily formed. In this embodiment, the temporary lock piece 65 and the connection piece 66 have approximately the same width in the Y-axis direction, but may have different width in the Y-axis direction according to diameter of the lead part 12*a* of the wire 12, for example.

Similarly, the grip piece 74 consists of a temporary lock piece 75 and a connection piece 76. A slit 77 extending the X-axis direction and the Z-axis direction is formed between the temporary lock piece 75 and the connection piece 76. The slit 67 and the slit 77 have the same width in the Y-axis direction, but may have different width in the Y-axis direction.

A broad portion 78 whose width is larger than that of a base end part is also formed at the tip of the connection piece 76 before forming the lead connection part 78*a*, and the broad portion is to mainly be the lead connection part 78*a*. The broad portion 78, however, may not be necessarily formed. In this embodiment, the temporary lock piece 75 and the connection piece 76 have approximately the same width in the Y-axis direction, but may have different width in the Y-axis direction according to diameter of the lead part 12*b* of the wire 12, for example.

As shown in FIG. 4, a shielding piece 63 as a shielding member is integrally formed outside in the Y-axis direction of the wire connection rising piece 62. The shielding piece 63 has approximately the same width in the Z-axis direction as the wire connection rising piece 62. A tip in the Y-axis direction of the shielding piece 63 is bent in the X-axis direction toward the terminal space concave part 47*a*, and is preferably substantially flush with one of the side surfaces 40*a* in the Y-axis direction of the first flange 40. This is because a shielding effect of laser beam by the shielding piece 63 mentioned below and compactness of the device are achieved at the same time.

Note that, the tip in the Y-axis direction of the shielding piece 63 may slightly protrude outside in the Y-axis direction more than the side surface 40*a* in the Y-axis direction of the first flange 40, or may be slightly dented inside in the Y-axis direction. The bent tip of the shielding piece 63 enters into the terminal space concave part 47*a* of the first flange 40, but is configured to avoid contacting with the drum core 20 including the first flange 40.

A shielding piece 73 similar to the shielding piece 63 is integrally formed outside in the Y-axis direction of the wire connection rising piece 72. The shielding piece 73 has approximately the same width in the Z-axis direction as the wire connection rising piece 72. A tip in the Y-axis direction of the shielding piece 73 is bent in the X-axis direction toward the terminal space concave part 48*a*, and is preferably substantially flush with the other side surface 40*a* in the Y-axis direction of the first flange 40. This is because a shielding effect of laser beam by the shielding piece 73 mentioned below and compact of the device are achieved at the same time.

Note that, the tip in the Y-axis direction of the shielding piece 73 may slightly protrude outside in the Y-axis direction more than the side surface 40*a* in the Y-axis direction of the first flange 40, or may be slightly dented inside in the Y-axis direction. The bent tip of the shielding piece 73 enters into the terminal space concave part 48*a* of the first flange 40, but is configured to avoid contacting with the drum core 20 including the first flange 40.

As shown in FIG. 5 and FIG. 6, fillet forming pieces 69 and 79 are formed integrally at a midway position in the X-axis direction of an outer end in the Y-axis direction of the attachment pieces 61 and 71 of the respective terminal electrodes 60 and 70. The fillet forming pieces 69 and 79 are configured to engage and contact with the engagement concave parts 40*a*1 formed on the side surfaces 40*a* in the Y-axis direction of the first flange 40. The engagement concave parts 40*a*1, however, may not necessarily formed. Preferably, the fillet forming pieces 69 and 79 rise in the Z-axis direction approximately as high as or lower than a thickness in the Z-axis direction of the first flange 40.

Next, a manufacturing method of the coil device 2 shown in FIG. 1A to FIG. 4 will be explained. First, the drum core 20 shown in FIG. 5 is molded. The drum core 20 is molded by any method, such as compression molding, ceramic injection molding (CIM), and metal injection molding (MIM). The drum core 20 is fired after being molded to obtain a sintered body.

Next, the first terminal electrode 60 and the second terminal electrode 70 are attached on the winding axis directional outer end surface 42 of the first flange 40 of the drum core 20. Note that, the first terminal electrode 60 and the second terminal electrode 70 can be easily molded by punching and bending a metal plate (e.g., copper plate). After or before attaching the terminal electrodes 60 and 70 on the drum core, the coil part 10 is formed by winding the wire 12 around the winding core 30 of the drum core 20 shown in FIG. 5.

Figure 7:
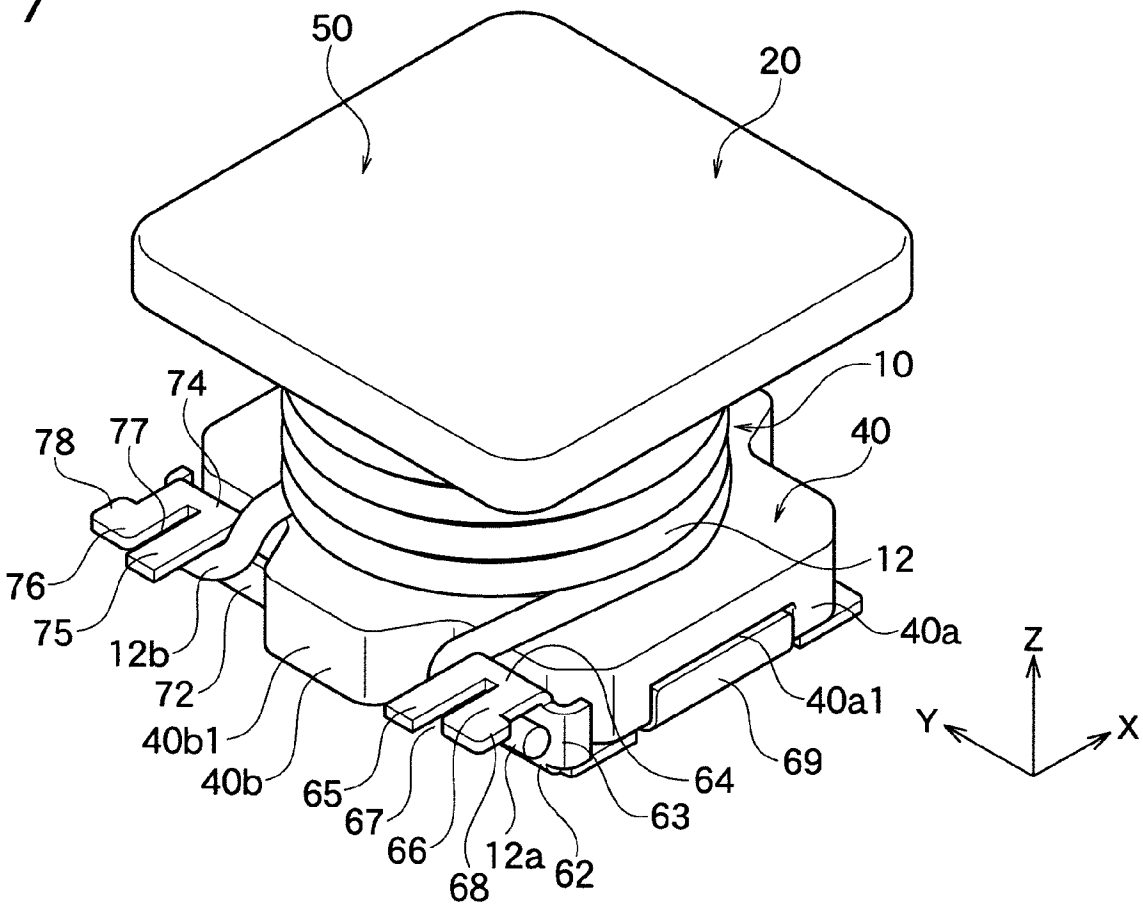
FIG. 7 is a perspective view showing a manufacturing step of the coil device shown in FIG. 1.

As shown in FIG. 7, the lead parts 12*a* and 12*b*, which are both ends of the wire of the coil part 10, are located below in the Z-axis direction of the grip piece 64 of the first terminal electrode 60 and the grip piece 74 of the second terminal electrode 70, while the coil part 10 is formed around the winding core 30. In this condition, next, as shown in FIG. 8, only the temporary lock pieces 65 and 75 are bent, and the respective lead parts 12*a* and 12*b* are sandwiched between the temporary lock pieces 65 and 75 and the rising pieces 62 and 72 so as to be temporarily locked below the grip pieces 64 and 74.

Figure 8:
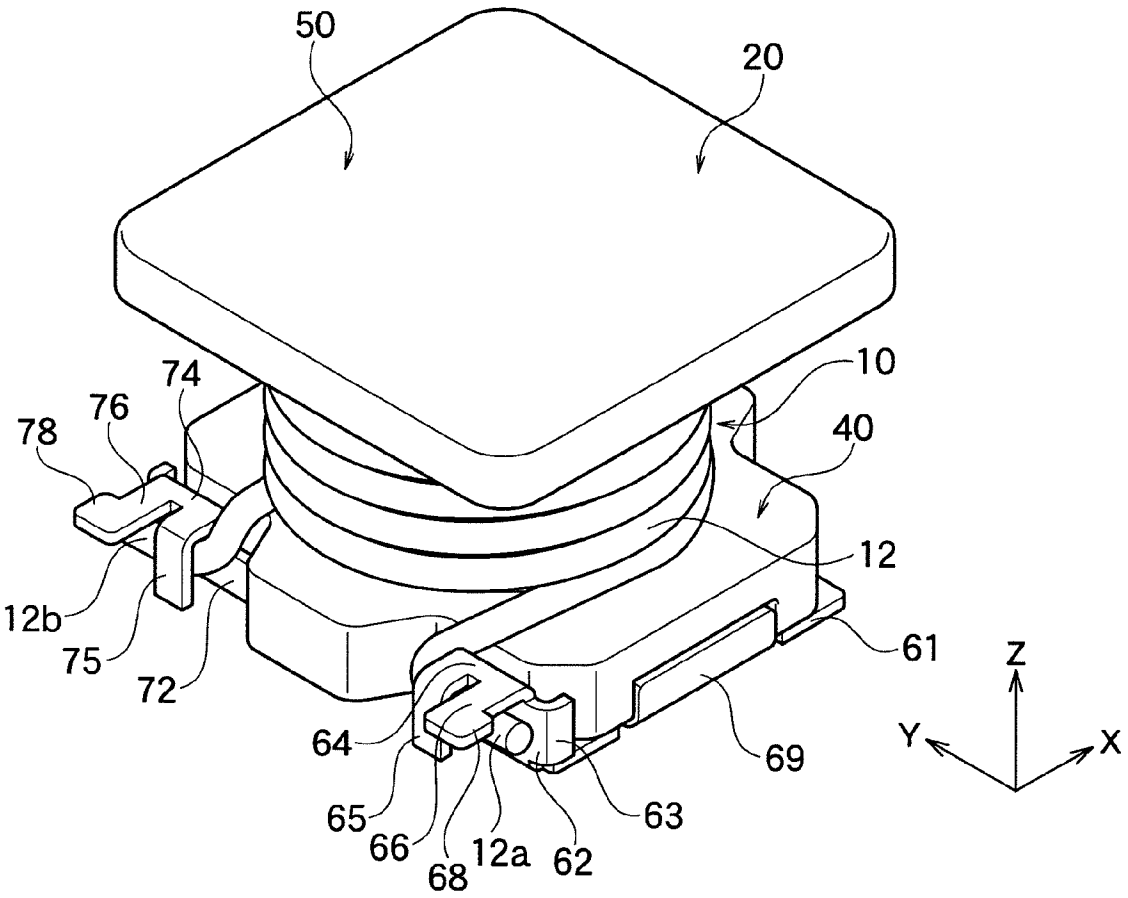
FIG. 8 is a perspective view showing a following step of FIG. 7.

In this condition, when the lead parts 12*a* and 12*b* shown in FIG. 8 are viewed from the front side in the X-axis direction, the lead parts extending from the temporary lock pieces 65 and 75 toward outside in the Y-axis direction can be seen without being hidden by the connection piece 68.

In this condition, a coating layer, such as polyamide imide, formed around an outer periphery of the wire constituting the lead parts 12*a* and 12*b* can be peeled by irradiating a laser beam for peeling coating layer from the front side in the X-axis direction toward the lead parts 12*a* and 12*b* protruding from the respective temporary lock pieces 65 and 75.

Even if the laser beam is irradiated, the drum core 20 is not irradiated by the laser beam due to the rising pieces 62 and 72 and the shielding pieces 63 and 73, which can prevent deterioration of the drum core. Also, since the lead parts 12*a* and 12*b* are irradiated by the laser beam while being temporarily locked by the temporary lock pieces 65 and 75, the coating layer of the wire is peeled to only the temporary lock pieces 65 and 75 and is not peeled in an unnecessary area. Note that, when using a wire without necessity to peel its coating layer as the wire 12, this peeling step of the coating layer by laser irradiation is unnecessary.

Figure 9:
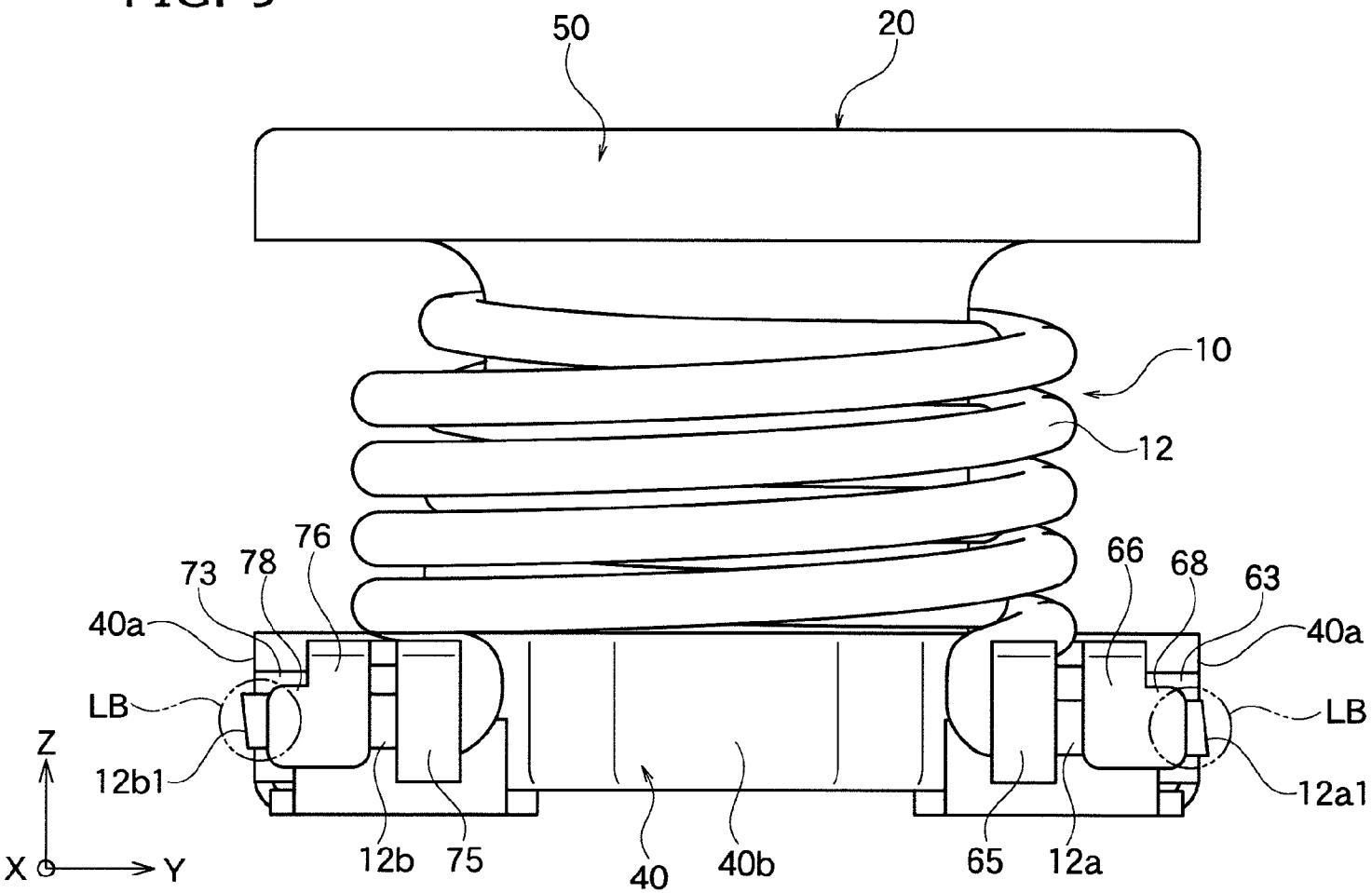
FIG. 9 is a perspective view showing a following step of FIG. 8.

Next, as shown in FIG. 9, the connection pieces 66 and 76 (including the broad portions 68 and 78) are bent, and the tips of the lead parts 12*a* and 12*b* are sandwiched to be temporarily locked. In this condition, tips 12*a*1 and 12*b*1 of the lead parts 12*a* and 12*b* protrude slightly more than the outer ends in the Y-axis direction of the broad portions 68 and 78, and may protrude more than the side surfaces 40*a* in the Y-axis direction of the first flange 40.

In this condition, a laser beam for welding is irradiated from the front side in the X-axis direction toward irradiation areas LB (e.g., circular irradiation areas) including the tips 12*a*1 and 12*b*1 of the lead parts 12*a* and 12*b* and parts of the broad portions 68 and 78. As shown in FIG. 1B, at least the tip of the lead part 12*a* and the connection piece 66 (including the broad portion 68) are consequently integrated to form the lead connection part 68*a*. Similarly, at least the tip of the lead part 12*b* and the connection piece 76 (including the broad portion 78) are consequently integrated to form the lead connection part 78*a*. As a result of the laser welding, the outer ends in the Y-axis direction of these lead connection parts 68*a* and 78*a* are approximately flush with the side surfaces 40*a* in the Y-axis direction of the first flange 40, or are dented more than the side surfaces 40*a* in the Y-axis direction.

Even if the laser beam for welding is irradiated, the drum core 20 is not irradiated by the laser beam due to the rising pieces 62 and 72 and the shielding pieces 63 and 73, which can prevent deterioration of the drum core. Upon performing the laser welding, as shown in FIG. 9, the broad portions 68 and 78 are preferably located in front of the lead parts 12*a* and 12*b* when viewing from the irradiation direction of the laser beam.

In this configuration, with the laser beam irradiation, the tips 12*a*1 and 12*b*1 of the lead parts 12*a* and 12*b* are melted, shrunk inside in the Y-axis direction, and integrated with the broad portions 68 and 78. Thus, the lead connection parts 68*a* and 78*a* of welded balls having almost ball shape shown in FIG. 1B are easily made. Note that, the welded ball has any outer diameter, but preferably has an outer diameter of 0.35 to 0.45 mm. Preferably, the lead connection parts 68*a* and 78*a* of the welded balls are not integrated with but separate from the shielding pieces 63 and 73 and the rising pieces 62 and 72 located behind in the X-axis direction. More preferably, the shielding pieces 63 and 73 are held in space between the lead connection parts 68*a* and 78*a* of the welded balls and the first flange 40 of the core 20, but they may be slightly contacted with each other.

Note that, the figures illustrate that the lead connection parts 68*a* and 78*a* are formed by integration of only the tips of the lead parts 12*a* and 12*b* and the broad portions 68 and 78, but the ball-shaped lead connection parts 68*a* and 78*a* may be formed by integration of the tips of the lead parts 12*a* and 12*b* and the connection pieces 66 and 76 depending on the energy amount of the laser beam. Also, the temporary lock pieces 65 and 75 may be respectively integrated with the ball-shaped lead connection parts 68*a* and 78*a*.

In the coil device 2 of the present embodiment, as shown in FIG. 4, the rising piece facing planes 45*a* and 45*b* are formed on one of the side surfaces 40*b* in the X-axis direction of the first flange 40 so as to face the rising pieces 62 and 72 of the terminal electrodes 60 and 70 and position the wire connection parts. Thus, the grip pieces 64 and 74 included by the connection parts of the terminal electrodes 60 and 70 are favorably positioned with respect to the first flange 40 of the drum core, and the lead parts 12*a* and 12*b* of the wire 12 at the grip pieces can be more securely connected to the terminal electrodes 60 and 70 by laser irradiation. Thus, the wire can be connected in a firm and secure manner.

In the coil device 2 of the present embodiment, the terminal space concave parts 47*a* and 48*a* are formed with the rising piece facing planes 45*a* and 46*a* on the side surface 40*b* of the first flange 40 and dent from the rising piece facing planes 45*a* and 46*a* toward inside so as to form spaces between the terminal space concave parts 47*a* and 48*a* and the rising pieces 62 and 72 (including the shielding pieces 63 and 73). Thus, it is possible to reduce thermal impact at the time of performing laser welding against the lead parts 12*a* and 12*b* of the wire 12 and the wire connection parts of the terminal electrodes 60 and 70, and effectively prevent problems of the core 20, such as breakage and crack. Also, an external force affected on the terminal electrodes 60 and 70 is absorbed by the spaces between the side surface 40*b* of the first flange 40 and the rising pieces 62 and 72 of the terminal electrodes 60 and 70, and thus the external force can be effectively prevented from disconnecting the wire 12 and breaking the core 20. Further, heat dissipation of the wire connection parts is improved by the spaces between the side surface 40*b* of the first flange 40 and the rising pieces 62 and 72 of the terminal electrodes 60 and 70.

In this embodiment, the second flange 50 has an outer shape size that is larger than that of the first flange 40, which makes it easy to form the notches 44 (see FIG. 4) for positioning the rising pieces 62 and 72 of the terminal electrodes 60 and 70 at the corners of the first flange 40.

That is, in this embodiment, the terminal fittings 60 and 70 can be minimized to protrude to the second flange 50 without decrease in inductance while maintaining the size of the flanges 40 and 50, and the terminal fittings 60 and 70 and the lead connection parts 68*a* and 78*a* hardly collide with a mounting apparatus or so during transportation of the coil device.

In this embodiment, the slits 67 and 77 are formed in the grip pieces 64 and 74, which improves heat dissipation. Also, the slits 67 and 77 between the temporary lock pieces 65 and 75 and the connection pieces 66 and 76 make it easy to control the size of the welded ball lead connection parts 68*a* and 78*a*, and can easily form the lead connection parts 68*a* and 78*a* whose size is convenient for connection.

Further, in this embodiment, the lead parts 12*a* and 12*b* of the wire 12 for winding and the terminal electrodes 60 and 70 are connected by laser welding (1000° C. or higher), which is higher than a temperature (230 to 280° C.) of forming a solder fillet. Thus, the wire 12 can be connected in a firm and secure manner.

In the coil device 2 of this embodiment, the rising pieces 62 and 72 are formed only at one ends in the X-axis direction of the attachment pieces 61 and 71, and no rising pieces are formed at the other ends. Thus, the terminal electrodes 60 and 70 can be effectively prevented from dislocating along the X-axis direction, compared with prior arts.

Note that, in the prior arts, rising pieces are also formed at the other end, and solder fillets are formed thereat. Then, no solder fillets are formed at the rising pieces 62 and 72 for the connection parts 68*a* and 78*a* by laser welding. Thus, in the prior arts, the coil device 2 may be dislocated with the terminal electrodes 60 and 70 as a whole in the X-axis direction with respect to the circuit board due to the external force of the solder fillet attached on the rising pieces formed at the other ends.

On the other hand, in the present embodiment, no rising pieces are formed at the other ends in the X-axis direction of the attachment pieces 61 and 71. Instead, the solder fillets during mounting are formed on the fillet forming pieces 69 and 79 integrally risen from one ends in a lateral direction (Y-axis direction) crossing a longitudinal direction (X-axis direction) of the attachment pieces 61 and 71 along the side surfaces 40*a* in the Y-axis direction of the first flange 40. The solder fillets achieve a firm connection between a circuit board for mounting (not shown) and the terminal electrodes 60 and 70, which can effectively prevent dislocation of the terminal electrodes 60 and 70 along the X-axis direction.

The following effects can be expected by providing the terminal electrodes 60 and 70 with the fillet forming pieces 69 and 79. That is, when the coil device 2 is mounted on a circuit board, for example, solder attached on the lower surfaces of the terminals 60 and 70 is also attached on the outer surfaces of the fillet forming pieces 69 and 79, and it is possible to confirm how much the solder is attached thereon without being behind the second flange 50 when viewing from above in the Z-axis direction.

Note that, since a pair of the terminal electrodes 60 and 70 is attached on the winding axis directional outer end surface 42 of the first flange 40, the dislocation in the Y-axis direction of the terminal electrodes is prevented by interaction of facing joining force of the solder fillets formed on the fillet forming pieces 69 and 79 respectively formed on a pair of the terminal electrodes 60 and 70.

In this embodiment, the lead connection parts 68*a* and 78*a* having the lead parts 12*a* and 12*b* of the wire 12 connected with the connection pieces 66 and 76 are formed within a range of a thickness of the first flange 40. In this configuration, the coil device 2 can be made compact.

Further, in this embodiment, the fillet forming pieces 69 and 79 rise lower than a thickness in the winding axis direction of the first flange 40. In this configuration, the coil device 2 can be made compact. Also, the exterior resin 15 is hardly attached on the fillet forming pieces 69 and 79 and does not disturb formation of the solder fillets during mounting.

In this embodiment, the engagement concave parts 40*a*1 engaged with the fillet forming pieces 69 and 79 are formed on the side surfaces 40*a* in the Y-axis direction of the first flange 40. The terminal electrodes 60 and 70 and the core 20 are easily positioned by engaging the fillet forming pieces 69 and 79 with the engagement concave parts 40*a*1. Also, the exterior resin 15 is hardly attached on the fillet forming pieces 69 and 79 and does not disturb formation of the solder fillets during mounting.

The fillet forming pieces 69 and 79 have outer surfaces that are flush with or dented more than the side surfaces 40*a* in the Y-axis direction other than the engagement concave parts 40*a*1. This configuration improves handling characteristics of the coil device 2 before mounting. That is, the edges of the fillet forming pieces 69 and 79 are not caught with or damage other component or device.

As shown in FIG. 9, the laser beam LB is irradiated from the X-axis direction to connect the tips 12*a*1 and 12*b*1 of the lead parts 12*a* and 12*b* of the wire 12 and the broad portions 68 and 78 of the connection pieces 66 and 76. The shielding pieces 63 and 73 are arranged behind the tips 12*a*1 and 12*b*1 of the lead parts 12*a* and 12*b* and the broad portions 68 and 78 of the connection pieces 66 and 76. Thus, the laser beam LB is shielded by the shielding pieces 63 and 73.

Even if the connection piece 66 is arranged near the core 20 for compactness of the device, the core 20 is not damaged by a laser beam or its reflection during laser welding. Thus, the core 20 is not broken or cracked by thermal impact.

The shielding pieces 63 and 73 are held in space between the lead connection parts 68*a* and 78*a* and the first flange 40 of the core 20, which makes it hard to transmit thermal affection of the laser beam at the time of making a welded ball to the core 20, and makes it possible to further reduce damage of the core 20.

Further, the shielding pieces 63 and 73 are formed integrally with the respective terminal electrodes 60 and 70, which removes necessity to separately prepare a shielding piece and contributes to reduction in the number of components.

Note that, the present invention is not limited to the above embodiment, and can be variously changed within the scope thereof.

For example, the shielding member of the present invention is made of ceramic or metal, and may be attached to only a necessary area of the core 20 or molded integrally.

In the above-mentioned embodiment, as shown in FIG. 5 and FIG. 7, the temporary lock pieces 65 and 75 and the connection pieces 68 and 78 are open before the laser welding. Thereafter, as shown in FIG. 8, the temporary lock pieces 65 and 75 are bent, and the connection pieces 68 and 78 are subsequently bent. As shown in FIG. 6, however, the temporary lock pieces 65 and 75 and the connection pieces 68 and 78 may be bent from the beginning.

That is, at least the temporary lock pieces 65 and 75 may be bent beforehand in an upper convex shape in the Z-axis direction so as to contain the lead parts 12*a* and 12*b* of the wire 12 from below in the Z-axis direction. This is the case with the connection pieces 68 and 78.

In the terminal electrodes 60 and 70 of the above-mentioned embodiment, no plating film is preferably formed on the surfaces contacted with the drum core 20 for improvement of adhesiveness with the drum core, but tin plating may be formed on the rear surface to be a solder joining surface with the circuit board for improvement of adhesiveness with solder.

The lead parts 12*a* and 12*b* of the wire 12 for winding and the terminal electrodes 60 and 70 may be connected by not only laser welding but by thermocompression (300° C. or higher), for example, which is performed at a temperature higher than that (230 to 280° C.) for forming the solder fillet. In this embodiment, the lead parts 12*a* and 12*b* of the wire 12 for winding and the terminal electrodes 60 and 70 are connected at a temperature higher than that for forming the solder fillet. Thus, the wire can be connected in a firm and secure manner.

The invention claimed is:

1. A coil device comprising:

a magnetic core having a winding core wound by a wire to form a coil;

a first flange and a second flange having a substantially planar shape and integrally formed at both ends in the winding axis direction of the winding core; and a terminal electrode attached on an outer end surface of the first flange formed at an end in a winding axis direction of the winding core, wherein the terminal electrode comprises:

an attachment piece contacted with the outer end surface of the first flange;

a wire connection rising piece integrally risen from one end in a longitudinal direction of the attachment piece along a side surface in a first axis direction of the first flange; and a connection piece formed integrally with an upper end side of the wire connection rising piece and having a welded ball connected to a lead part of the wire by laser welding, and wherein a laser shielding member is arranged between the welded ball and the magnetic core, the side surface in the first axis direction of the first flange includes:

a rising piece facing plane facing the wire connection rising piece in such a manner as to be contactable with the wire connection rising piece to position the connection piece; and a terminal space concave part caved inside from the rising piece facing plane to form a space between the terminal space concave part and the wire connection rising piece, the shielding member is formed integrally with the wire connection rising piece of the terminal electrode, the shielding member is held in space between the welded ball and the terminal space concave part of the magnetic core, the first flange has notches dented more largely than the second flange so that an outer shape size of the first flange is smaller than that of the second flange, the rising piece facing plane and the terminal space concave part are formed on the notches, and the wire connection rising piece is located inside the notches.

2. The coil device as set forth in claim 1, wherein a lead connection part consisting of the welded ball is formed within a range of a thickness of the first flange.

3. The coil device as set forth in claim 1, wherein an exterior resin surrounds the winding core wound by the wire.

4. The coil device as set forth in claim 1, wherein a temporary lock piece for temporarily locking the lead part of the wire is formed integrally with the upper end side of the wire connection rising piece and separately from the connection piece.

5. The coil device as set forth in claim 1, wherein the shielding member is formed integrally with the wire connection rising piece to shield the magnetic core from being irradiated by a laser beam irradiated for connecting a tip of the lead part of the wire and the connection piece from a direction crossing the side surface in the first axis direction toward the connection piece and the tip of the lead part of the wire.

6. A coil device comprising:

a magnetic core having a winding core wound by a wire to form a coil;

a first flange and a second flange having a substantially planar shape and integrally formed at both ends in a winding axis direction of the winding core; and a terminal electrode attached on an outer end surface of the first flange formed at an end in the winding axis direction of the winding core, wherein the terminal electrode comprises:

an attachment piece contacted with the outer end surface of the first flange;

a wire connection rising piece integrally risen from one end in a longitudinal direction of the attachment piece along a side surface in a first axis direction of the first flange;

a connection piece formed integrally with an upper end side of the wire connection rising piece and connected with a lead part of the wire; and a fillet forming piece integrally risen from one end in a lateral direction crossing the longitudinal direction of the attachment piece along a side surface in a second axis direction of the first flange, and wherein the lead part of the wire is connected with the connection piece at a temperature equal to or higher than a melting temperature of a solder fillet to be formed on the fillet forming piece, the first flange has notches dented more largely than the second flange so that an outer shape size of the first flange is smaller than that of the second flange, the side surface in the first axis direction of the first flange includes:

a rising piece facing plane facing the wire connection rising piece to position the connection piece; and a terminal space concave part caved inside from the rising piece facing plane to form a space between the terminal space concave part and the wire connection rising piece, the rising piece facing plane and the terminal space concave part are formed on the notches, and the wire connection rising piece is located inside the notches.

7. The coil device as set forth in claim 6, wherein a lead connection part having the lead part of the wire connected with the connection piece is formed within a range of a thickness of the first flange.

8. The coil device as set forth in claim 6, wherein an exterior resin surrounds the winding core wound by the wire.

9. The coil device as set forth in claim 6, wherein the fillet forming piece rises lower than a thickness in the winding axis direction of the first flange.

10. The coil device as set forth in claim 6, wherein an engagement concave part engaged with the fillet forming piece is formed on the side surface in the second axis direction of the first flange.

11. The coil device as set forth in claim 6, wherein a temporary lock piece for temporarily locking the lead part of the wire is formed integrally with the upper end side of the wire connection rising piece and separately from the connection piece.

12. The coil device as set forth in claim 6, wherein the shielding member is formed integrally with the wire connection rising piece to shield the magnetic core from being irradiated by a laser beam irradiated for connecting a tip of the lead part of the wire and the connection piece from a direction crossing the side surface in the first axis direction toward the connection piece and the tip of the lead part of the wire.

13. The coil device as set forth in claim 1, wherein a tip in the second axis direction of the shielding piece is bent in the first axis direction toward the terminal space concave part, and is substantially flush with one of the side surfaces in the second axis direction of the first flange.

14. The coil device as set forth in claim 1, wherein the wire connection rising piece located inside the notches and formed on the first flange is hidden by corners of the second flange in a view from the winding axis direction.

15. The coil device as set forth in claim 6, wherein the wire connection rising piece located inside the notches and formed on the first flange is hidden by corners of the second flange in a view from the winding axis direction.

* * * * *